US006295954B1

(12) United States Patent
Suzuki

(10) Patent No.: US 6,295,954 B1
(45) Date of Patent: Oct. 2, 2001

(54) CYLINDER BLOCK FOR WATER-COOLED ENGINE

(75) Inventor: Hajime Suzuki, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/532,326

(22) Filed: Mar. 21, 2000

(30) Foreign Application Priority Data

Apr. 2, 1999 (JP) ..... 11-095668

(51) Int. Cl.[7] ..... F02B 75/18
(52) U.S. Cl. ..... 123/41.74; 123/193.2
(58) Field of Search ..... 123/41.72, 41.74, 123/193.2

(56) References Cited

U.S. PATENT DOCUMENTS 2,507,034 * 5/1950 Martin ..... 115/17
2,853,062 * 9/1958 Barr et al. ..... 123/41.74
4,066,057 * 1/1978 Hale ..... 123/193 CH
4,237,847 * 12/1980 Baugh et al. ..... 123/195 R
4,520,768 * 6/1985 Shimonosono et al. ..... 123/41.44
6,024,056 * 2/2000 Hojyo et al. ..... 123/41.79

FOREIGN PATENT DOCUMENTS 08-028342 1/1996 (JP) .
10-311242 11/1998 (JP) .

* cited by examiner

*Primary Examiner*—Tony M. Argenbright
*Assistant Examiner*—Katrina B. Harris
(74) *Attorney, Agent, or Firm*—Foley & Lardner

(57) ABSTRACT

A cylinder block for a water-cooled internal combustion engine has a top deck, a cylinder wall structure defining a row of cylinder bores, and a water jacket wall structure defining a water jacket around the cylinder bores. The jacket wall structure has a plurality of cylinder head bolt bosses each formed with a bolt hole for a cylinder head bolt for fastening a cylinder head on the top deck of the cylinder block. At least one of the head bolt bosses is a terminal head bolt boss which is formed at an end portion of the cylinder block, and which is connected, by a rib, with the cylinder wall structure and the top deck to prevent stress concentration and cracks.

16 Claims, 6 Drawing Sheets

CYLINDER BLOCK FOR WATER-COOLED ENGINE

BACKGROUND OF THE INVENTION

The present invention relates to cylinder blocks for water-cooled internal combustion engines, and more specifically to cylinder blocks of a closed deck type.

In general, a cylinder block for a water-cooled engine is a single casting including a cylinder wall forming cylinder bores, and a water jacket wall forming a water jacket. Specifically, the casting process of cost-advantageous cast iron (gray iron) using sand cores is often employed for a closed deck type cylinder block having a top deck covering the water jacket to improve the sealing of a cylinder head gasket.

Japanese Patent Kokai Publications Nos. 10311242 (published on Nov. 24, 1998) and 08028342 (published on Jan. 30, 1996) show cylinder blocks having head bolt bosses receiving cylinder head bolts joining a cylinder head on top of a top deck.

SUMMARY OF THE INVENTION

It is an object of the present invention to provide a cylinder block designed to prevent stress concentration specifically around a cylinder head bolt boss.

According to the present invention, a cylinder block for a water-cooled internal combustion engine, comprises:

a row of cylinder wall sections each defining a cylinder bore;

a water jacket wall defining a water jacket around the row;

a top deck connecting upper ends of the cylinder wall sections and an upper end of the water jacket wall and thereby defining an upper end of the water jacket;

a head bolt boss having a cylinder head bolt hole, the head bolt boss being formed in the water jacket wall; and a rib formed between the head bolt boss located at an end of the cylinder block and an adjacent one of the cylinder wall sections, and connected with the head bolt boss, the top deck, and the adjacent one of the cylinder wall sections.

According to another aspect of the present invention, a cylinder block for a water-cooled internal combustion engine, comprises: a top deck; a cylinder wall structure extending underneath the top deck and defining a row of cylinder bores; and a jacket wall structure extending underneath the top deck and defining a water jacket around the cylinder wall structure. The jacket wall structure comprises:

a jacket wall comprising first and second end wall sections, and first and second side wall sections, the first end wall section being located between a first longitudinal end of the cylinder block and the row of the cylinder bores, the second end wall section being located between a second longitudinal end of the cylinder block and the row of the cylinder bores, the first and second side wall sections extending from the first end wall section to the second end wall section along the row, the first side wall section being on a first side of the row, and the second side wall section being on a second side of the row opposite to the first side;

intermediate head bolt bosses formed in the first and second side wall sections of the jacket wall, each intermediate head bolt bosses having a cylinder head bolt hole; and at least one terminal head bolt boss having a cylinder head bolt hole, the terminal head bolt boss being formed in the first end wall section, and connected with the cylinder wall structure by a rib extending from the top deck.

DETAILED DESCRIPTION OF THE INVENTION

Figure 1:
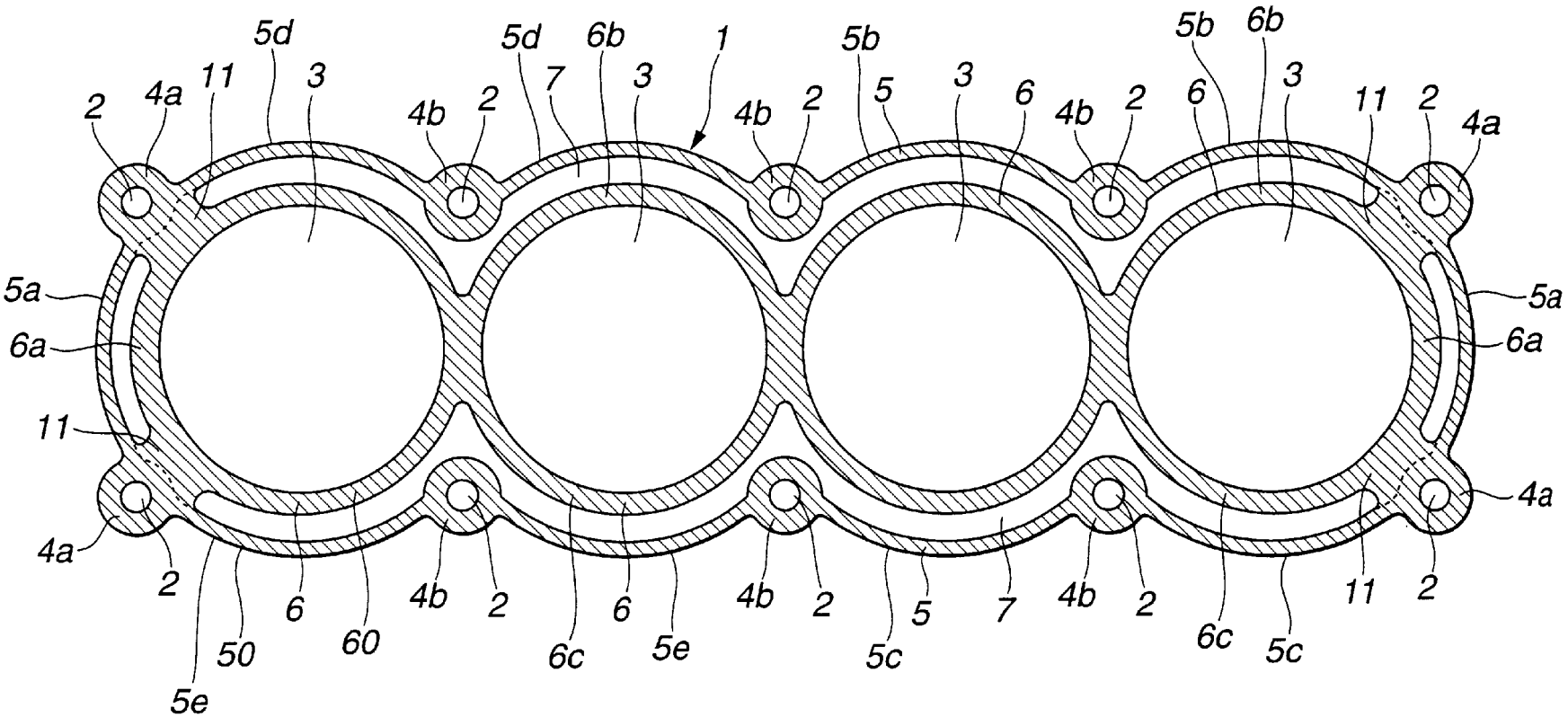
FIG. 1 is a sectional view of a cylinder block according to one embodiment of the present invention, taken at a level closely below a top deck.
Figure 2:
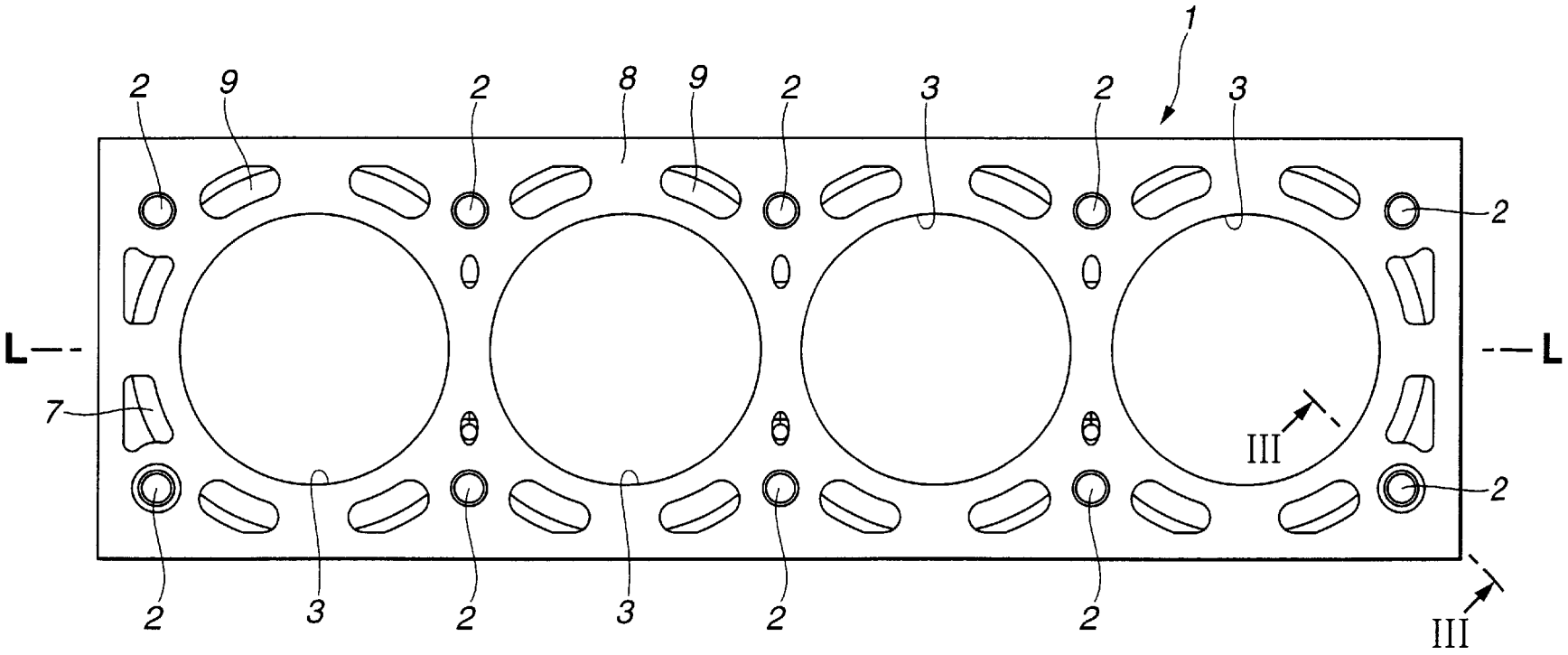
FIG. 2 is a plan view showing the top deck of the cylinder block of FIG. 1.

FIGS. 1~4 shows a cylinder block 1 according to one embodiment of the present invention. The cylinder block of this example is for an inline four cylinder internal combustion engine. The cylinder block 1 of this example is a single integral casting of cast iron formed by casting process with sand cores. The cylinder block 1 has a top deck 8 of a closed deck type, as shown in FIG. 2.

A cylinder wall structure 60 extends underneath the top deck 8 and defines an inline row of cylinder bores 3, as shown in the sectional view of FIG. 1 taken under and near the top deck 8. In this example, the cylinder wall structure 60 includes four cylinder wall sections 6 each of which is approximately in the form of a hollow cylinder defining a unique one of the four cylinder bores 3. The cylinder wall structure 60 of this example is a siamesed type, and the cylinder wall sections 6 are conjoined in series to reduce the inter-bore separation. However, it is optional to employ an arrangement in which the cylinder wall sections 6 are separate and independent from one another. In the case of the siamesed type, the cylinder wall structure 60 has a first joint section at which the first and second cylinder wall sections 6 are joined together, a second joint section between the second and third cylinder wall sections 6 and a third joint section between the third and fourth cylinder wall sections 6. Each cylinder wall section 6 comprises a first side cylindrical wall subsection 6*b* and a second side cylindrical wall subsection 6*c*. In each of the second and third cylinder wall sections (or intermediate cylinder wall sections) 6 between the first and fourth cylinder wall sections (or terminal cylinder wall sections) 6, the first and second side cylindrical wall subsections 6*b* and 6*c* are approximately semicylindrical, extends between the adjacent two of the joint sections, and confront each other to define one of the cylinder bores 3.

A water jacket wall structure 50 extends, underneath the top deck 8, around the cylinder wall structure 60, and defines a water jacket (space) 7 around the cylinder wall structure 60. The jacket wall structure 50 has a water jacket wall 5 extending around the cylinder wall structure 60 so as to maintain an approximately constant spacing therebetween. The width of the water jacket 7 is approximately uniform. The water jacket 7 is bounded and covered by the top deck 8. As shown in FIG. 2, the top deck 8 has a plurality of communication holes 9 opening into the water jacket 7 and connecting the water jacket 7 of the cylinder block 1 with the water jacket in the cylinder head.

The jacket wall 5 includes first and second end wall sections 5*a,* and first and second side wall sections 5*b* and 5*c*. The cylinder block 1 extends along a longitudinal direction from a first longitudinal end of the cylinder block 1 to a second longitudinal end. The cylinder bores 3 are arranged in a line along the longitudinal direction. The first end wall 5*a* extends, generally along a lateral direction of the cylinder block 1, between the first longitudinal end of the cylinder block 1 and the row of the cylinder bores 3. The second end wall 5*a* extends laterally between the second longitudinal end of the cylinder block 1 and the row of the cylinder bores 3. The first longitudinal end of the cylinder block 1 is one of right and left ends of the cylinder block as viewed in FIG. 2. The first and second side wall sections 5*b* and 5*c* extend generally along the longitudinal direction from the first end wall 5*a* to the second end wall 5*a*. The first side wall 5*b* is located on a first side of the row which is one of upper and lower sides as viewed in FIG. 1. The second side wall 5*c* is on a second side of the row opposite to the first side.

The jacket wall structure 50 has a plurality of intermediate head bolt bosses 4*b* distributed in the first and second side wall sections 5*b* and 5*c*. Each intermediate head bolt bosses 4*b* has a cylinder head bolt hole 2. In this example, there are six of the intermediate head bolt bosses 4*b* which are arranged in first, second and third pairs. Each pair consists of a first boss formed in an upper portion of the first side wall section 5*b* and a second boss formed in an upper portion of the second side wall section 5*c*. The first pair is located between the first and second cylinder bores 3, the second pair is between the second and third cylinder bores 3, and the third pair is between the third and fourth cylinder bores 3.

First and second terminal (or corner) head bolt bosses 4*a* are formed in each of the first and second end wall sections 5*a*. Each of the terminal bosses 4*a* has a cylinder head bolt hole 2, like the intermediate bosses 4*b*.

Each of the first and second side wall sections 5*b* and 5*c* of the jacket wall structure 50 has cylindrical wall subsections 5*d* or 5*e*. In this example, there are four of the cylindrical wall subsections 5*d* or 5*e* in each side wall section 5*b* or 5*c*. Each cylindrical wall subsection 5*d* or 5*e* extends so as to describe an arc of a circle concentric with one of the cylinder bores 3 along a corresponding one of the cylindrical side wall subsections 6*b* or 6*c* of the cylinder wall structure 60 with a uniform spacing therebetween.

As shown in FIG. 2, the top deck 8 has a rectangular top surface in which the head bolt holes 2 of the first and second terminal head bolt bosses 4*a* are open, respectively, at two corners of each (first or second) longitudinal end of the cylinder block 1. On each of the left and right sides of an imaginary longitudinal center plane (or median plane) L-L splitting each cylinder bore into equal left and right semicylinders, five of the head bolt holes 2 are aligned in an imaginary plane parallel to the imaginary longitudinal center plane L-L. In this example, the cylinder block 1 is substantially bilateral-symmetric with respect to the imaginary longitudinal center plane. Moreover, the cylinder block 1 of this example is substantially bilateral-symmetric with respect to an imaginary lateral center plane which extends between the second and third cylinder bores 3 and intersects the imaginary longitudinal center plane L-L at right angles. Each of the head bolt holes 2 is adapted to receive a head bolt for fastening a cylinder head on the top surface of the cylinder block 1.

Figure 4:
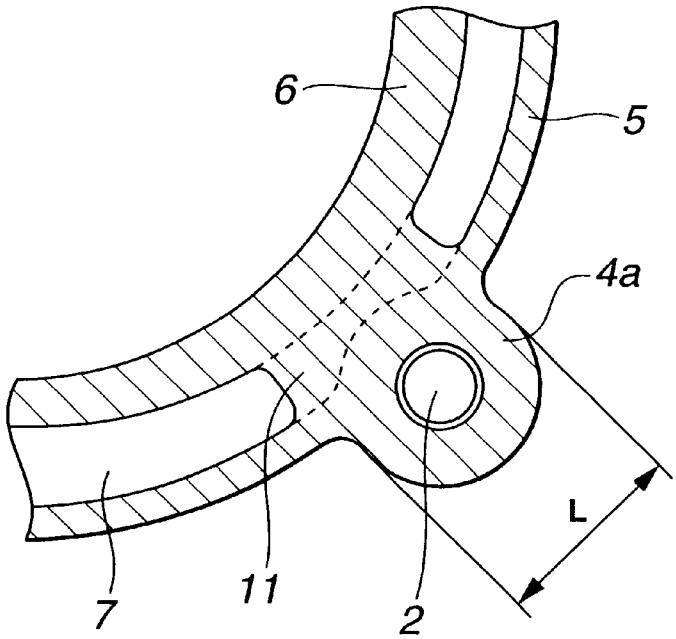
FIG. 4 is an enlarged view of a part of FIG. 1 for showing one cylinder head bolt boss in the cylinder block of FIG. 1.

Each head bolt boss 4*a* or 4*b* extends downward from the top deck 8 to a lower boss end, and bulges inward toward the cylinder wall structure 60 as well as outward so as to locally increase the wall thickness of the water jacket wall 5. In this example, each head bolt boss 4*a* or 4*b* is cylindrical, and the head bolt hole 2 is formed at the center of the boss, as shown in FIGS. 1 and 4.

Figure 7:
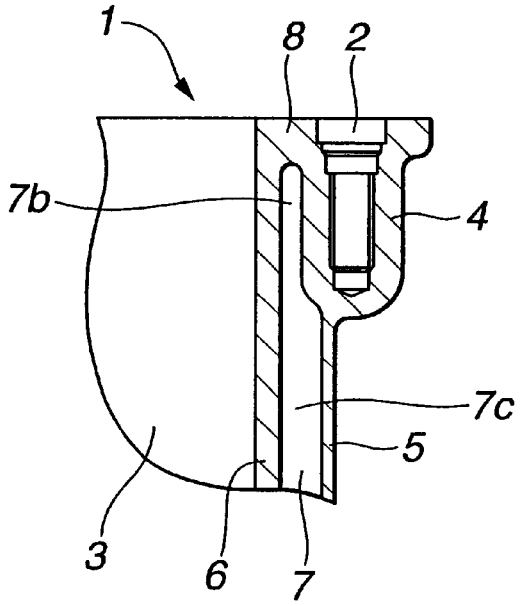
FIG.7 PRIOR ART
FIG. 7 is a sectional view taken across a line VII—VII of FIG. 6.

Each of the intermediate head bolt bosses 4*b* is located between the locations of two adjacent cylinder bores 3, and spaced from the cylinder wall structure 60. Between each intermediate head bolt boss 4*b* and an adjacent one of the cylinder wall sections 6, there is formed a narrowed upper water jacket section 7*b* reaching the top deck 8. The narrowed upper water jacket section 7*b* extends downward from the top deck 8 to an upper end of a lower jacket section 7*c* which has a width greater than the width of the narrowed upper water jacket section 7*b* and which extends downward below the head bolt boss 4, in the same manner as shown in FIG. 7.

A rib 11 is formed between each terminal head bolt boss 4*a* and the cylinder wall structure 60. There are only four ribs 11 each is connected with a unique one of the four terminal head bolt bosses 4*a*. No such ribs are formed for the intermediate head bolt bosses 4*b*.

Figure 3:
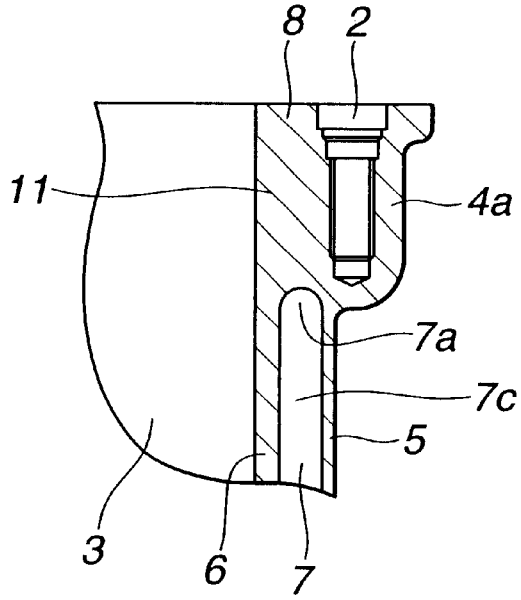
FIG. 3 is a sectional view take across a line III—III in FIG. 2.

In the region between each terminal head bolt boss 4*a* and the cylinder wall structure 60, the corresponding rib 11 extends downward from the top deck 8 so as to fill the region, and connects the terminal head bolt boss 4*a* and the cylinder wall structure 60. In this region, there is no narrowed upper water jacket section 7*b*. As shown in FIG. 3, the rib 11 extends downward from the top deck 8 along the adjacent terminal head bolt boss 4*a* to a lower rib end. The (vertical) length of the rib 11 is approximately equal to the (vertical or axial) length of the head bolt boss 4*a*. The rib 11 extends circumferentially around the adjacent cylinder bore 3, and has a width approximately equal to the diameter L of the cylindrical head bolt boss 4*a* as shown in FIG. 4. In this example, an inside cylindrical surface of each terminal head bolt boss 4*a* is entirely covered and buried by the corresponding rib 11. The rib 11 connects the adjacent terminal head bolt boss 4*a,* the adjacent terminal cylinder wall section 6 and the top deck 8 together, and thereby forms a portion shaped like a single integral block.

The lower end of each rib 11 defines an arched upper end 7*a* of the water jacket 7 having a span equal to the width of the lower jacket section 7*c* as shown in FIG. 3. In this example, as shown in FIG. 3, the arched upper end 7*a* is in the shape of a semicircle whose diameter is equal to the width of the lower jacket section 7*c* which extends downward below the terminal head bolt boss 4*a*. The arched upper end 7*a* formed by each rib 11 is located at a lower level below the top deck 8 whereas the narrowed jacket section 7*b* formed by each intermediate head bolt boss 4*b* extends upward along the adjacent intermediate head bolt boss 4*b* and reaches the top deck 8 in the manner as shown in FIG. 7.

As shown in FIG. 1, at each longitudinal end of the cylinder block 1, two of the ribs 11 extend, respectively, in first and second radial directions diverging from the center of the adjacent terminal bore 3 on both sides of the imaginary longitudinal center plane L-L, and forming an angle which, in this example, is approximately equal to 90°.

Each of the terminal cylinder wall sections 6 (that are the cylinder wall sections defining the first and last cylinder bores in the inline row of the cylinder bores) has an end wall subsection 6*a* extending, circumferentially around the axis of the adjacent terminal bore 3, between the ribs 11 of the terminal head bolt bosses 4*a,* and thereby defining the terminal cylinder bore 3 with the first and second side cylindrical wall subsections 6*b* and 6*c* which extend circumferentially around the axis of the terminal cylinder bore 3 toward the next cylinder bore on the first and second sides.

Figure 5:
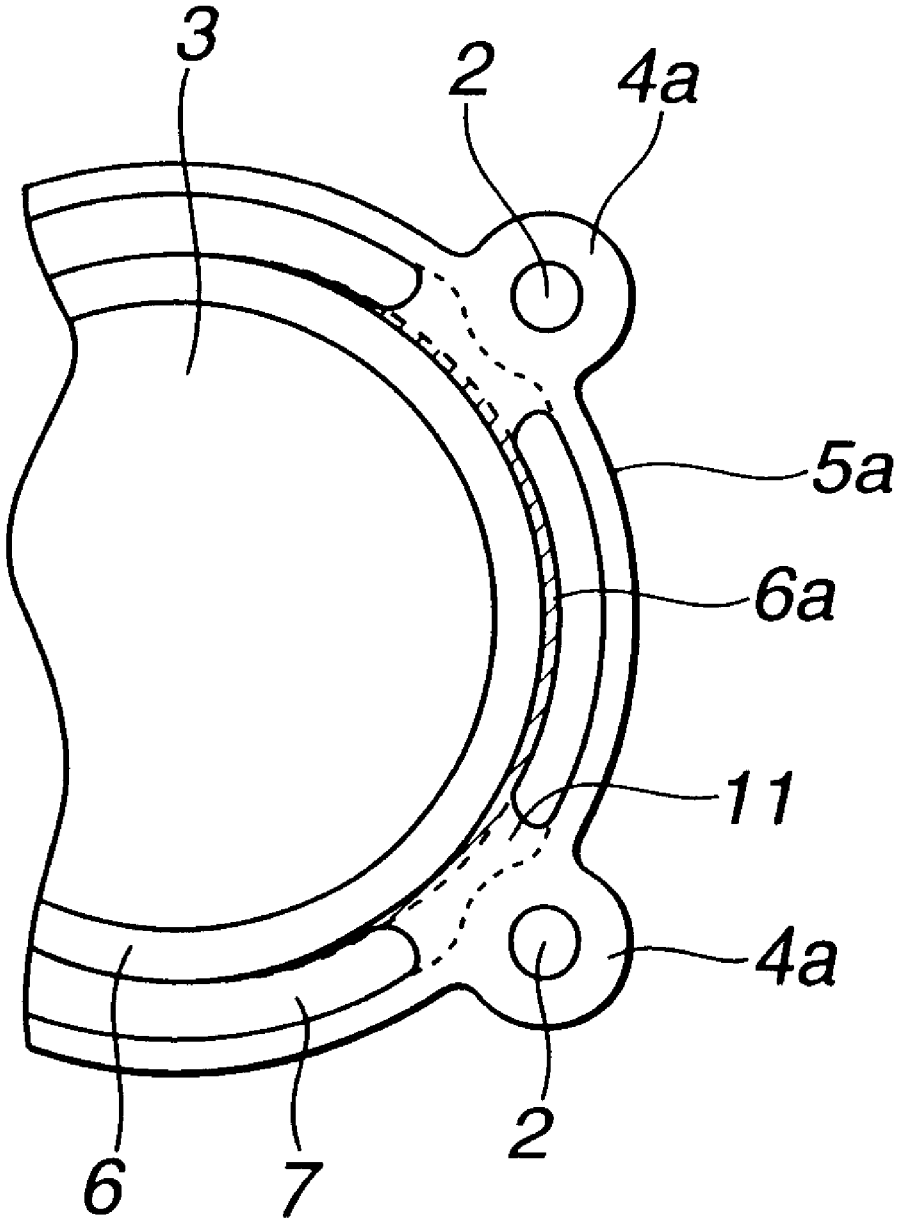
FIG. 5 is a sectional view for showing a thick cylinder wall section of the cylinder block of FIG. 1.

The end wall subsection 6*a* of each terminal cylinder wall section 6 has a wall thickness greater than the wall thickness of each of the first and second side wall subsections 6*b* and 6*c.* As shown in the sectional view of FIG. 5, a hatched region is added to the end wall subsection 6*a* to increase the wall thickness. In this example, the hatched region extends beyond the rib 11 on each of the first and second sides of the imaginary longitudinal center plane L-L, and the thick wall region extend over an angular distance of about 180°. On each of the first and second sides of the imaginary longitudinal center plane L-L, the wall thickness decreases gradually from the middle located on the imaginary longitudinal center plane L-L toward a point located at an angular distance of about 90° from the middle. Therefore, the hatched region is shaped like a crescent. The width of the water jacket 7 is slightly decreased by the hatched region. It is optional to decrease the wall thickness of the thick wall region gradually or stepwise along the downward direction toward the lower end of the cylinder wall.

Figure 6:
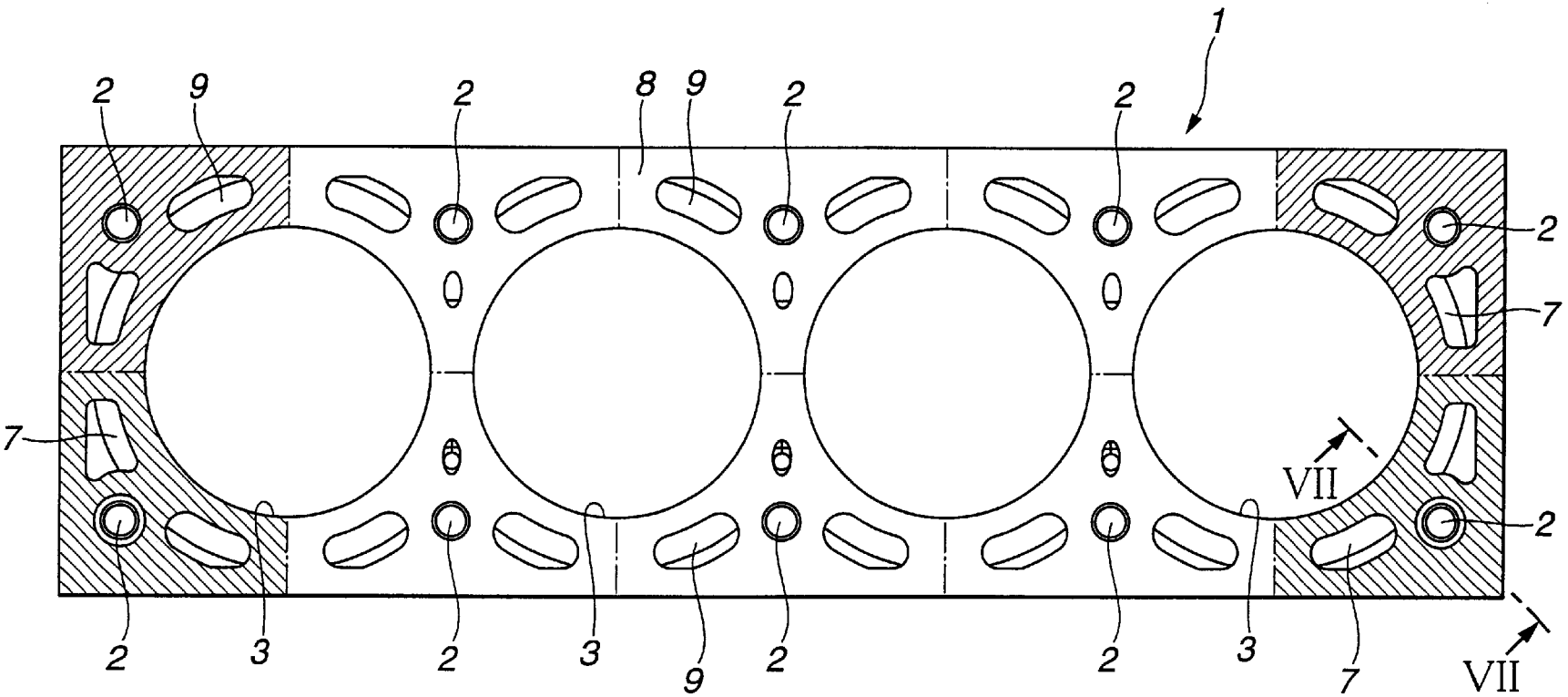
FIG.6 PRIOR ART
FIG. 6 is a plan view showing a top deck of a cylinder block according to a related art.

For comparison with the cylinder block 1 according to the embodiment of the present invention, FIGS. 6 and 7 show a cylinder block of a related art having no ribs. The cylinder block 1 of FIGS. 6 and 7 has a top deck 8 having a flat top surface on which a cylinder head for forming combustion chambers is placed. The cylinder block further has a plurality of cylinder head bolt bosses formed in a water jacket wall by machining. Each cylinder head bolt boss has a head bolt hole for receiving a cylinder head bolt for fastening the cylinder head on top of the cylinder block. As shown in FIG. 7, the water jacket 7 formed between the cylinder wall 6 and the jacket wall 5 has an upper jacket section 7*b* which is locally narrowed by each head bolt boss 4.

In this cylinder block shown in FIGS. 6 and 7, a cylinder head bolt located between two adjacent cylinders applies its axial force equally on both of the adjacent cylinders. As to a cylinder head bolt located at an end of the cylinder block, on the other hand, the axial force is applied on the only adjacent cylinder. Each of the four terminal head bolts located at the four corners of the rectangular top deck acts to fasten one of four hatched corner regions as shown in FIG. 6. Each of the six inter-cylinder head bolts acts to fasten one of six inter-cylinder regions each has an area approximately twice that of the corner regions. Therefore, the tightening stress increases around each terminal head bolt as compared to the inter-cylinder head bolts. In particular, the stress tends to concentrate in the top end of the narrowed water jacket section 7*b* shown in FIG. 7.

Figure 8:
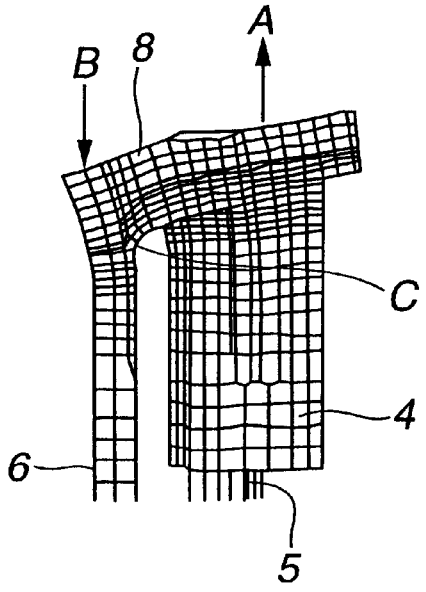
FIG.8 PRIOR ART
FIG. 8 is a view for illustrating a head bolt boss in a deformed state of the cylinder block of FIG. 6.

FIG. 8 illustrates a deformed condition around one head bolt boss 4. As shown in FIG. 8, the head bolt boss 4 receives an upward pulling load as shown by an arrow A due to the axial bolt force whereas the portion of the cylinder wall 6 receives a downward pushing load as shown by an arrow B by a bead of the cylinder head gasket. Therefore, great tensile stress acts in a portion C at the upper end of the water jacket.

Similarly, the stress due to the difference in thermal expansion during engine operation increases around the terminal head bolt bosses as compared to the inter-cylinder head bolt bosses.

In the casting process for cast iron cylinder blocks, to form pearlite contributory to improvements in the wear and abrasion resistance of the bores 3, and to shorten the production tact time, the mold is generally dismantled before the temperature decreases below the eutectoid transformation point (about 720° C.), and the growth of the structure terminates. After the removal of the mold, the top deck cools fast because of the outside air, while the cylinder wall 6 cools slowly around the cylinder bores where the surface radiation tends to keep the heat. As a result, the cylinder wall 6 terminates the structure growth while pulling the top deck 8, so that there arise residual stresses in the upper end portion of the water jacket 7 where the upper end of the cylinder wall 6 and the top deck 8 are connected together.

By the combination of the residual stresses and the tightening stresses of the cylinder head bolt, a crack is liable to occur near each terminal head bolt boss, starting from the narrowed upper end of the water jacket 7.

Annealing is effective for removing such internal stresses and preventing cracks. However, the heat treatment constitutes a factor for increasing the manufacturing cost.

By contrast, in the cylinder block 1 according to the illustrated embodiment of the present invention, each terminal head bolt boss 4*a* is rigidly connected by the rib 11, with the adjacent cylinder wall section 6 and the top deck 8. This structure can disperse tightening stresses due to the axial force of a cylinder head bolt, and residual stresses, and improve the rigidity around the terminal head bolt boss 4*a*. Moreover, this structure can restrain deformation of the top deck 8 and thereby maintain the flatness or smoothness to the advantage of the sealing between the cylinder head and the cylinder block. By formation of the rib 11, the radius of the curvature of the upper end 7*a* of the water jacket 7 is increased, so that this structure further prevent crack due to stress concentration.

In the present invention, a rib or ribs 11 may be formed only for part of the terminal head bolt bosses 4*a*.

The cylinder block 1 according to this embodiment has only the four ribs 11 for the terminal head bolt bosses 4*a*. The intermediate head bolt bosses 4*b* have no such ribs. This structure can achieve the effective reinforcement with the minimum weight increase. Therefore, this structure can eliminate the need for annealing for removal of the residual stress in the casting process of cast iron in some cases.

The cylinder block structure having no narrowed water jacket sections 7*b* is advantageous for the delivery of molten metal and for reducing casting defects such as misrun.

The rib connecting each terminal head bolt boss 4*a* and the adjacent cylinder wall section 6 might cause deformation of the cylinder bore 3 by a portion of the cylinder wall section being pulled radially outwardly. The thick wall cylinder wall subsections 6*a* can prevent deformation of the cylinder wall sections, and improve the roundness. It is optional to employ a structure in which the wall thickness of the terminal cylinder wall sections is made entirely greater than the wall thickness of the intermediate cylinder wall sections. The wall thickness of the first and second side wall subsections 6*b* and 6*c* too is greater in the terminal cylinder wall sections than in the intermediate cylinder wall sections. It is further optional to increase the wall thickness of the terminal cylinder wall sections only in the upper region near the top deck 8.

This application is based on a prior Japanese Patent Application No. 11(1999)-95668. The entire contents of this Japanese Patent Application with a filing date of Apr. 2, 1999 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A cylinder block for a water-cooled internal combustion engine, comprising:

a row of cylinder wall sections each defining a cylinder bore;

a water jacket wall defining a water jacket around the row;

a top deck connecting upper ends of the cylinder wall sections and an upper end of the water jacket wall and thereby defining an upper end of the water jacket in the cylinder block;

a cylindrical head bolt boss having a cylinder head bolt hole, the head bolt boss being formed in the water jacket wall; and a rib formed between the head bolt boss located at an end of the cylinder block and an adjacent one of the cylinder wall sections, and connected with the head bolt boss, the top deck, and the adjacent one of the cylinder wall sections;

wherein said head bolt boss is a terminal head bolt boss, and the cylinder block further comprises a cylindrical intermediate head bolt boss having an inside cylindrical wall surface bared in the water jacket and separated from the cylinder wall sections.

2. The cylinder block according to claim 1, wherein the rib has a width which is approximately equal to a diameter of the cylindrical head bolt boss.

3. The cylinder block according to claim 1, wherein the rib extends downward alongside the head bolt boss from the top deck, a length of the rib is approximately equal to an axial length of the head bolt boss, the water jacket comprises a lower jacket section extending downward below the head bolt boss, and the rib has a lower rib end defining an arched upper jacket end of the water jacket, and the arched upper jacket end has a span which is substantially equal to a width of the lower jacket section.

4. The cylinder block according to claim 1, wherein the cylinder wall section connected with the rib comprises an end wall subsection defining an end of the row, and a side wall subsection defining one of the cylinder bores with the end wall subsection, and a wall thickness of the end wall subsection is greater than a wall thickness of the side wall subsection.

5. The cylinder block according to claim 1, wherein the cylinder block is a single casting of cast iron, and the cylinder wall sections, the water jacket wall, the head bolt boss and the rib are all integral parts of the single casting.

6. The cylinder block according to claim 1, wherein the rib extends downward from the top deck alongside the terminal head bolt boss, to a lower rib end defining an upper jacket end at a second level lower than a first level underneath the top deck.

7. The cylinder block according to claim 1, wherein the cylindrical wall surface of the intermediate head bolt boss bulges inward in the water jacket, and thereby defines a narrowed jacket section extending upward alongside the intermediate head bolt boss to an upper jacket end at a first level underneath the top deck, and the rib extends downward from the top deck alongside the terminal head bolt boss, to a lower rib end defining an upper jacket end at a second level lower than the first level.

8. The cylinder block according to claim 1, wherein said terminal head bolt boss bulges outward from the water jacket wall.

9. A cylinder block for a water-cooled internal combustion engine, comprising:

a top deck;

a cylinder wall structure extending underneath the top deck and defining a row of cylinder bores;

a jacket wall structure extending underneath the top deck and defining a water jacket around the cylinder wall structure, the jacket wall structure comprising, a jacket wall comprising first and second end wall sections, and first and second side wall sections, the first end wall section being located between a first longitudinal end of the cylinder block and the row of the cylinder bores, the second end wall section being located between a second longitudinal end of the cylinder block and the row of the cylinder bores, the first and second side wall sections extending from the first end wall section to the second end wall section along the row, the first side wall section being on a first side of the row, and the second side wall section being on a second side of the row opposite to the first side, intermediate head bolt bosses formed in the first and second side wall sections, each intermediate head bolt bosses having a cylinder head bolt hole, and a terminal head bolt boss having a cylinder head bolt hole, the terminal head bolt boss being formed in the first end wall section, and connected with the cylinder wall structure by a rib extending from the top deck.

10. The cylinder block according to claim 9, wherein each of the intermediate head bolt bosses has a lower boss end and an inside surface which extends downward from the top deck to the lower boss end and which is spaced from the cylinder wall structure, and the rib extends downward from the top deck to a level of a lower end of the head bolt hole formed in the terminal head bolt boss.

11. The cylinder block according to claim 9, wherein an upper end of the water jacket is formed at a first level by the top deck between the cylinder wall structure and each of the intermediate head bolt bosses, and the rib has a lower rib end defining an upper end of the water jacket at a second level lower than the first level between the terminal head bolt boss and the cylinder wall structure.

12. The cylinder block according to claim 9, wherein each of the intermediate head bolt bosses bulges in the water jacket toward the cylinder wall structure and thereby defines a narrowed jacket section extending downward from the top deck between the intermediate head bolt boss and the cylinder wall structure, and a region between the terminal head bolt boss and the cylinder wall structure is filled by the rib.

13. The cylinder block according to claim 9, wherein the first end wall section of the jacket wall extends between the first longitudinal end of the cylinder block and a first bore which is one of the cylinder bores, and the jacket wall structure comprises first and second corner bosses formed in the first end wall section of the jacket wall, the first corner boss being the terminal bolt boss and being located on the first side of the row, the second corner boss having a cylinder head bolt hole, the second corner boss being located on the second side of the row, and connected with the cylinder wall structure by a rib extending from the top deck, the first end wall section of the jacket wall comprising an upper region extending from the first corner boss to the second corner boss.

14. The cylinder block according to claim 13, wherein the cylinder wall structure comprises a first cylinder wall section defining the first bore, and comprising an end wall subsection, first and second side cylindrical wall subsections, the end wall subsection of the first cylinder wall section extending from the rib of the first corner boss to the rib of the second corner boss, circumferentially around the first boss, and facing to the end wall section of the jacket wall structure, the first side cylindrical wall subsection extending from the rib of the first corner boss away from the first end wall subsection of the first cylinder wall section, the second side cylindrical wall subsection extending from the rib of the second corner boss away from the first end wall subsection of the first cylinder wall section, the end wall subsection of the first cylinder wall section being greater in wall thickness than each of the first and second side cylindrical wall subsections.

15. The cylinder block according to claim 13, wherein the cylinder wall structure comprises a first cylinder wall section defining the first bore, and comprising an end wall subsection, and a second cylinder wall section defining a second bore which is one of the cylinder bores and which is next to the first bore in the row, and comprising a side wall subsection , the end wall subsection of the first cylinder wall section extending from the rib of the first corner boss to the rib of the second corner boss, circumferentially around the first boss, and facing to the end wall section of the jacket wall structure, the side cylindrical wall subsection of the second cylinder wall section extending circumferentially around the second bore, the end wall subsection of the first cylinder wall section being greater in wall thickness than the side cylindrical wall subsection of the second cylinder wall section.

16. The cylinder block according to claim 13, wherein a first one of the intermediate head bolt bosses is a first inter-cylinder boss formed in the first side wall section of the jacket wall, a second one of the intermediate head bolt bosses is a second inter-cylinder boss formed in the second side wall section of the jacket wall, the first and second inter-cylinder bosses are located at a first inter-cylinder longitudinal location between longitudinal locations of the first bore and a second bore which is one of the cylinder bores and which is next to the first bore in the row, and the first cylinder wall section is surrounded by the first and second inter-cylinder bosses and the first and second corner bosses.

* * * * *